US009687090B2

(12) United States Patent
Ireland et al.

(10) Patent No.: US 9,687,090 B2
(45) Date of Patent: Jun. 27, 2017

(54) STANDALONE MERCHANDISE DISPLAY AND STORAGE TABLE

(71) Applicants: David Scott Ireland, Winston-salem, NC (US); David Marrell Rogers, Lewisville, NC (US)

(72) Inventors: David Scott Ireland, Winston-salem, NC (US); David Marrell Rogers, Lewisville, NC (US)

(73) Assignee: Imageworks Display & Marketing Group, Winston-Salem, NC (US)

( * ) Notice: Subject to any disclaimer, the term of this patent is extended or adjusted under 35 U.S.C. 154(b) by 0 days.

(21) Appl. No.: 14/881,721

(22) Filed: Oct. 13, 2015

(65) Prior Publication Data

US 2017/0099962 A1 Apr. 13, 2017

(51) Int. Cl.

| | |
|---|---|
| ***B65G 1/10*** | (2006.01) |
| ***A47F 5/00*** | (2006.01) |
| ***A47F 5/16*** | (2006.01) |
| ***A47F 7/00*** | (2006.01) |
| ***A47B 1/05*** | (2006.01) |
| ***A47B 1/10*** | (2006.01) |

(52) U.S. Cl.

CPC ..... *A47F 5/0093* (2013.01); *A47B 1/05* (2013.01); *A47B 1/10* (2013.01); *A47F 5/0018* (2013.01); *A47F 5/16* (2013.01); *A47F 7/0071* (2013.01); *A47F 2005/165* (2013.01)

(58) Field of Classification Search

CPC ..... A47B 45/00; A47B 46/00; A47B 63/04; A47B 88/0085; A47B 2088/0422; A47B 88/06; A47B 96/025; A47F 3/004; A47F 3/06; A47F 5/0068; A47F 9/005; A47F 5/0093; B65G 1/023; B65G 1/026; B65G 1/06; B65G 1/10

See application file for complete search history.

(56) References Cited

U.S. PATENT DOCUMENTS 2,490,588 A * 12/1949 Haloski ..... A47B 31/00 193/1
4,441,432 A 4/1984 Carlton
4,620,489 A * 11/1986 Albano ..... A47B 96/025 108/105
4,717,112 A 1/1988 Pirkle
(Continued)

*Primary Examiner* — Mark Beauchaine
(74) *Attorney, Agent, or Firm* — Robert W. Pitts

(57) ABSTRACT

A standalone merchandise display and storage table on which retail merchandise is displayed includes one or more shelf subassemblies, which include a counter and a pull-out shelf that telescopes outwardly to provide additional display and storage space without interfering with merchandise stored on counters from which the pull-out shelves extends. Shelf subassemblies can be used in multiple levels, and the pull-out shelves can be extended to a tilted orientation so as not to interfere with merchandise displayed on a different level. The pull-out shelves can be retained when closed and when deployed in a fully extended, tilted position, as well as in intermediate positions. A cabinet supports a lower counter and a central compartment supports and upper counter thereabove. Extendable panels above the upper counter can be deployed for extra display and storage space or can be retracted for displaying advertising media.

16 Claims, 14 Drawing Sheets

(56) References Cited

U.S. PATENT DOCUMENTS

| | | | | |
|---|---|---|---|---|
| 5,078,283 | A * | 1/1992 | Wilson | A47F 5/101 160/135 |
| 5,531,159 | A * | 7/1996 | Stubblefield | A47F 5/0093 108/100 |
| 6,039,422 | A | 3/2000 | Butters et al. | |
| D446,406 | S | 8/2001 | Aeberhard | |
| 6,357,609 | B1 * | 3/2002 | Van Noord | A47B 45/00 108/65 |
| 6,497,185 | B1 | 12/2002 | Barrett et al. | |
| 6,840,590 | B2 | 1/2005 | Hightower | |
| 6,843,382 | B2 | 1/2005 | Kanouchi et al. | |
| 7,063,219 | B2 | 6/2006 | Fann et al. | |
| D618,932 | S | 7/2010 | Linder | |
| D651,429 | S | 1/2012 | Ussen | |
| 9,004,297 | B2 | 4/2015 | Sjolander et al. | |
| 2003/0025302 | A1 * | 2/2003 | Urffer, III | A47F 5/108 280/651 |

* cited by examiner

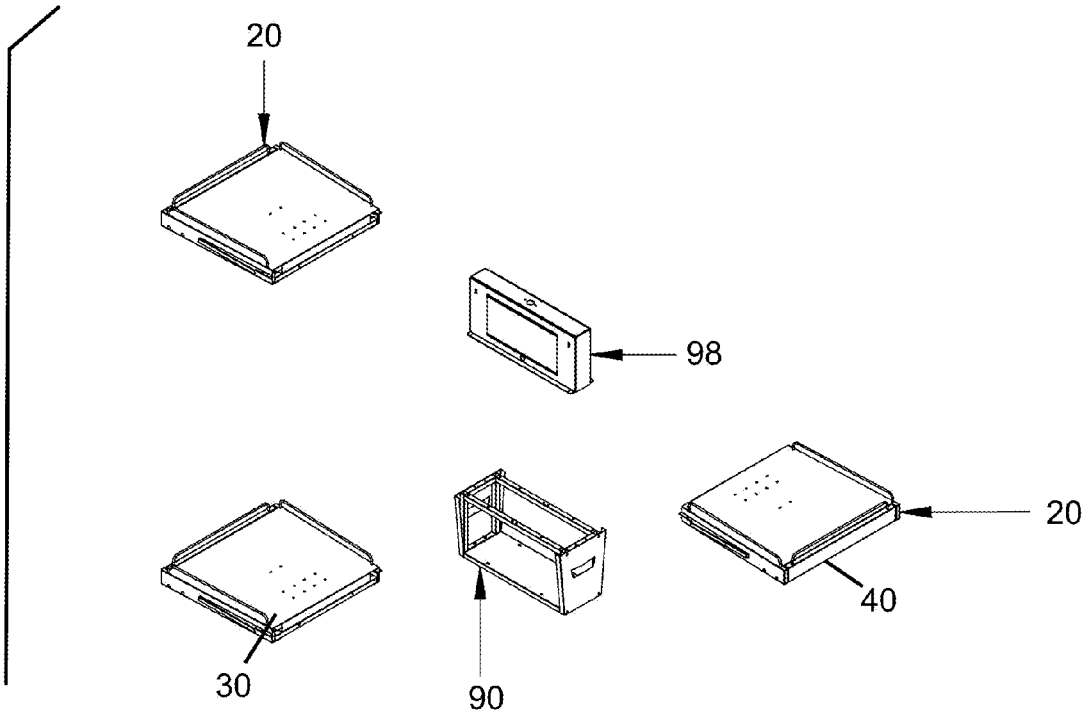
FIG 7
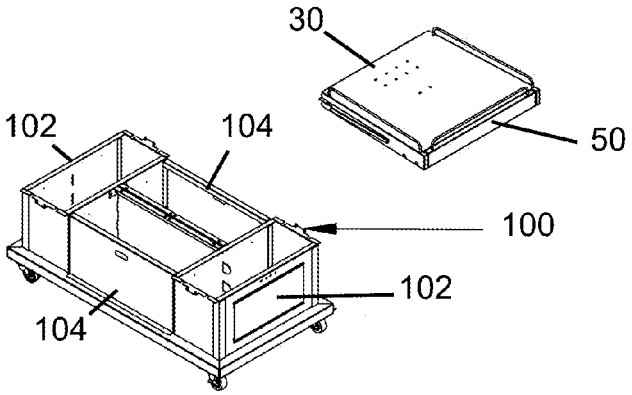

STANDALONE MERCHANDISE DISPLAY AND STORAGE TABLE

BACKGROUND OF THE INVENTION

Field of the Invention

This invention relates to tables having counter space and shelves for displaying merchandise for sale, and especially to standalone tables that can be used to display retail merchandise in the aisles of retail establishments, such as grocery stores.

Description of the Prior Art

It is a common practice for retail establishments, such as grocery stores, to employ tables to store and display merchandise for sale in the aisles between or around permanent display shelves and hardware, such as refrigeration equipment. Drop leaf tables, having shelves that extend from the ends of the tables are commonly employed. The shelves on such drop leaf tables can be retracted by folding them downward, leaving only the top of the table available for storage and display of retail merchandise. When raised to a horizontal position, generally in line with the top of the table, such shelves provide additional display space so that more items are available for purchase, especially as impulse sales. However, since the aisles must remain open for customer traffic, such drop leaf tables are normally positioned so that the shelves are on the ends of the tables and do not further decrease the width of the aisles. Merchandise display and storage is generally limited to one level when conventional drop leaf tables are employed in this manner. The total display area can thus be limited, either limiting the merchandise available for sale or requiring more frequent restocking.

Another option for standalone tables or shelving suitable for use in the aisles or other high traffic areas is to employ cabinets having multiple display areas or shelves positioned one on top of another. However, this may either limit the cohesiveness of the displayed items or entice a retailer to display competing merchandise in the same cabinet.

SUMMARY OF THE INVENTION

According to one aspect of this invention, a standalone merchandise display and storage table provides space for displaying and storing retail merchandise for sale in a retail establishment. This standalone merchandise display and storage table provides variable display and storage space for retail merchandise. This standalone merchandise display and storage table includes an upper counter located above a lower counter oriented so that retail merchandise stored on both the upper counter and the lower counter is accessible from all directions. An upper shelf is extendable from the upper counter, and a lower shelf is extendable from the lower counter. The upper shelf is shiftable relative to the upper counter to vary storage and display space for retail merchandise, and the lower shelf is shiftable relative to the lower counter also to vary storage and display space for retail merchandise. Thus the standalone merchandise display and storage table can appear fully stocked both when initially stocked with retail merchandise and as retail merchandise are depleted prior to restocking the upper and lower counters and upper and lower shelves. Shifting of the upper shelf and shifting of the lower shelf does not interfere with customer's access to retail merchandise displayed and stored on one of the other counter or shelf or with visibility of retail merchandise stored on one of the other counter or shelf.

According to another aspect of this invention, this standalone merchandise display and storage table includes a shelf subassembly with a counter and a shelf both providing space for display of merchandise. The shelf is shiftable relative to the counter to vary display and storage space of retail merchandise. The shelf shifts or extends relative to the counter from an initial position in which the shelf is retracted within the counter to one or more intermediate position in which the shelf extends beyond the counter and is securable in the same plane as the counter. The shelf also is extendable from an intermediate position to a final position in which the shelf is tilted relative to the counter, but securable, while remaining a display and storage space. Tracks are mounted on opposite sides of one of the counter and shelf and forward rolling bearings and trailing rolling bearings are mountable on opposite sides of the other of the counter and shelf. The forward rolling bearings and the trailing rolling bearings traverse the tracks as the shelf shifts between the initial and intermediate positions. The forward rolling bearings extend beyond and at least partially below the tracks in the final position and the trailing rolling bearings extend at least partially above the tracks in the final position to allow tilting of the shelf relative to the counter but retaining the shelf in a configuration for display and storage of merchandise when tilted.

According to another aspect of this invention, a grocery store merchandise and display table can be positioned in an aisle with access to the table on opposite sides and opposite ends, but resulting is limited obstruction of the aisle. The opposite sides are longer than the opposite ends to minimize obstruction of traffic in the aisles while being resizable to allow storage and display of varying amounts of product, the table comprising. A table base includes doors on opposite sides of the base. The doors can be shifted between horizontal and vertical positions, so that product is storable and accessible within the base when the doors are in the horizontal position. A first counter is located on top of the base. The first counter is open on opposite sides and opposite ends of the table for removal of product on the first counter by customers. A riser subassembly extends above a center section of the first counter. The riser subassembly has risers forming opposite end walls thereof with product being storable and accessible between the opposite end walls. A second counter is located above the first counter and supported by the riser. The second counter is open on opposite sides and ends for removal of product on the second counter by customers. First and second counters can have the same amount of area for the storage and display of product, with product on both the first and second counters being visible at all times. Oppositely facing upper panels are centrally positioned and extend above the second counter. The oppositely facing upper panels can serve as graphic display panels when in a vertical position and will provide additional storage and display space when rotated upwardly into a horizontal position above the second counter. The table can be configured to display varying amounts of product so as to be suitable of use in areas having different amounts of product turnover.

One advantage of the present invention is that an individual standalone table can be dedicated to merchandise offered by a single supplier. A standalone table of this sort could be provided to a retail establishment only for use in storing and displaying the merchandise of the supplier providing the table. Adjustment of the display size and area as in the current invention can thus limit the space available to competing suppliers so that competing products will not encroach upon that supplier as can occur with prior art display cabinets and tables. By adjusting the display size, the standalone table of the instant invention, it can always appear that the display table is fully stocked, even as supplies are gradually depleted. The standalone table of the instant invention can also allow a supplier to fully stock the display table less often than might be otherwise necessary because of the relatively large initial display area, making this display table especially suited for special promotions. When the shelves of the instant invention are returned to a closed position, it can still appear that the table is fully stocked, even though less merchandise may be on display. A single standalone table according to this invention would also be suitable for use by retailers having a relatively large customer base, while still suited for use by retailers who may have less traffic and therefore need smaller stocks. These features are not believed to be available with prior art standalone storage and display tables.

The instant invention employs pull-out shelves that can be extended to a tilted position in which the shelf is not in the same plane as the counter section from which it extends. In this tilted position, merchandise will still be displayed and stored on the tilted shelf, but this position will allow greater visibility and ease of access to merchandise stored on a counter from which the shelf extends. This is especially the case with multi-tier standalone tables, such as the preferred embodiment described herein. Conventional shelves used in prior art retail storage cabinets can be extended and tilted so that merchandise can be replenished, but these shelves do not remain tilted once they have been stocked. Unlike the present invention these shelves are returned to their normal horizontal position and do not provide additional display and storage space or increase the amount of product that can be seen and accessed by prospective customers.

BRIEF SUMMARY OF THE DRAWINGS

FIG. 7 is an exploded view of the main components of the standalone merchandise display and storage table shown in FIGS. 1-6.

DETAILED DESCRIPTION OF THE PREFERRED EMBODIMENT

Figure 1:
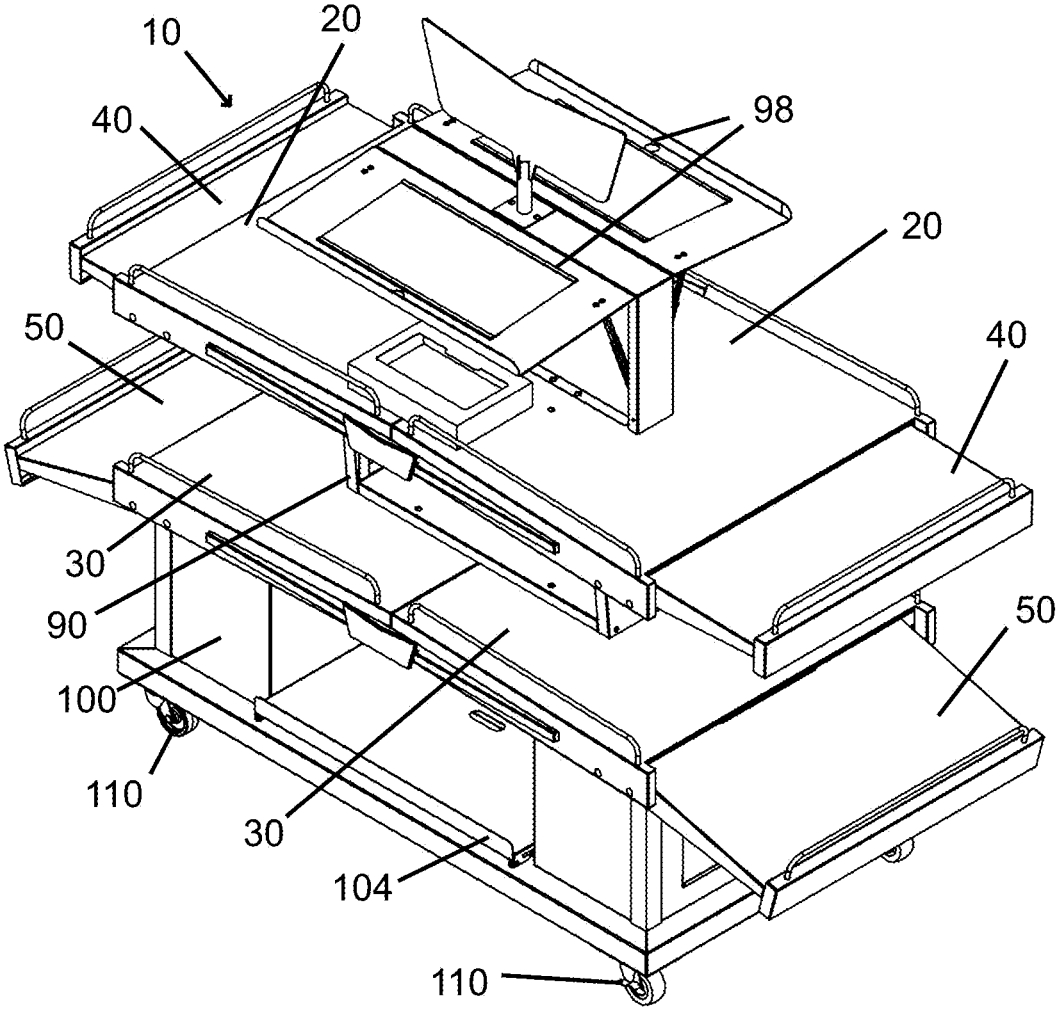
FIG. 1 is a three dimensional view of the standalone merchandise display and storage table according to this invention, with upper and lower shelves extended from opposite ends, but in different positions.
Figure 6:
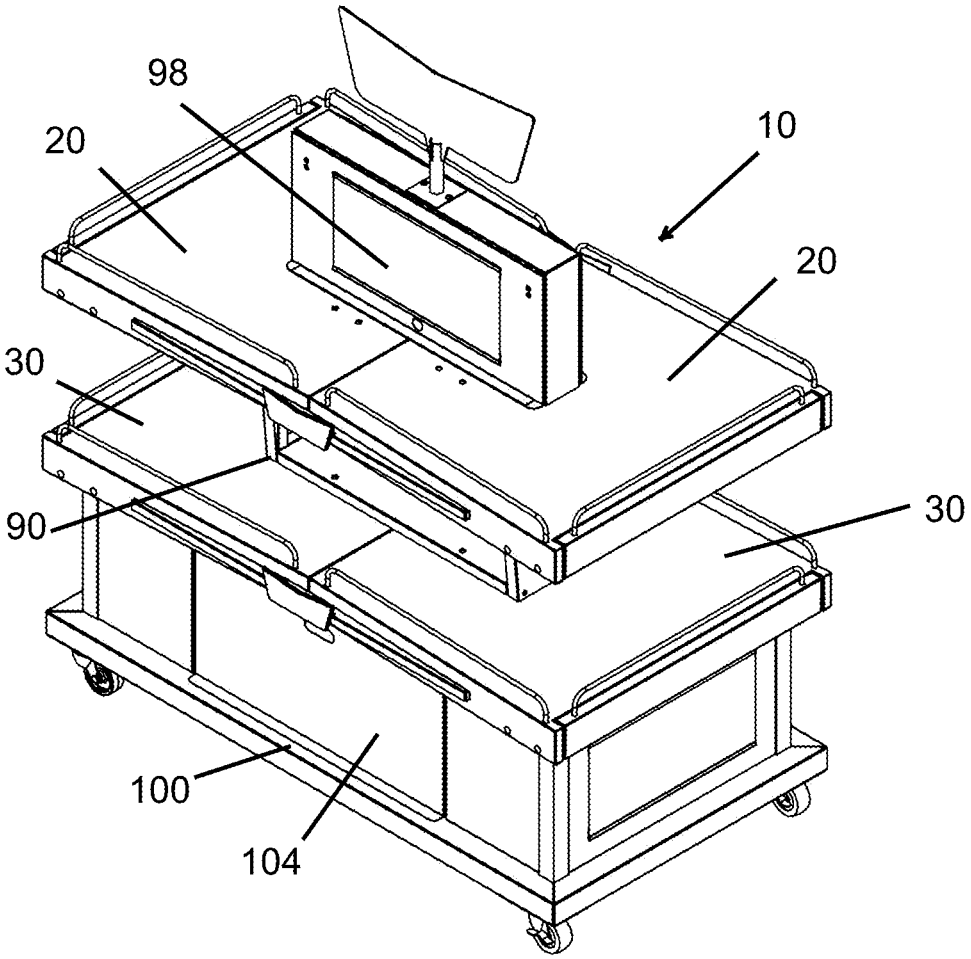
FIG. 6 is a three dimensional view of the standalone merchandise display and storage table in the position shown in FIG. 5.

The standalone merchandise display and storage table 10 according to this invention is depicted in FIG. 1, with its four shelves, comprising two upper shelves 40 and two lower shelves 50 deployed in different positions. FIG. 6 is a view of the same standalone merchandise display and storage table 10 with the upper shelves 40 and the shelves 50 all deployed in an initial or closed position leaving on the upper counter 20 and the lower counter 30 as the only exposed primary merchandise storage and display surfaces available in this minimum display configuration. Comparison of FIG. 1 with FIG. 6 shows that the amount of retail merchandise that is available is dependent upon the positions of the two upper pull-out shelves 40 and the two lower pull-out shelves 50. This standalone merchandise display and storage table 10 can therefore easily accommodate different quantities of retail merchandise while still appearing relatively fully stocked. Not only will the amount of display space be adjustable, but the size of the standalone merchandise display and storage table 10 can be adjusted to fit within available floor space in the aisles of a store, such as a grocery store. Wheels 110 can be mounted on the bottom of the table 10 so that the table is portable and can be moved from space to space without removing merchandise stored and displayed on the table 10.

In addition to the primary merchandise storage and display surfaces provided by the counters 20 and 30 and the pull-out shelves 40 and 50, there are additional surfaces that can be deployed for additional merchandise. As shown in FIG. 1, two upper panels 98 can be deployed in a horizontal configuration to provide additional space for retail merchandise. When closed, these panels 98 can provide space for displaying advertising or other media. A cabinet 100 above which the lower counter 30 is mounted can provide additional internal storage space. Side doors 104 can be rotated to a vertical position in which graphic material can be displayed. Alternately side doors 104 can be rotated to a horizontal position at the lower part of cabinet 100 to provide additional shelf space for storing and displaying merchandise. A riser subassembly 90 supporting the upper counter 20 above the lower counter 30 also provides additional storage and display space between riser panels 92 located on opposite ends.

Figure 2:
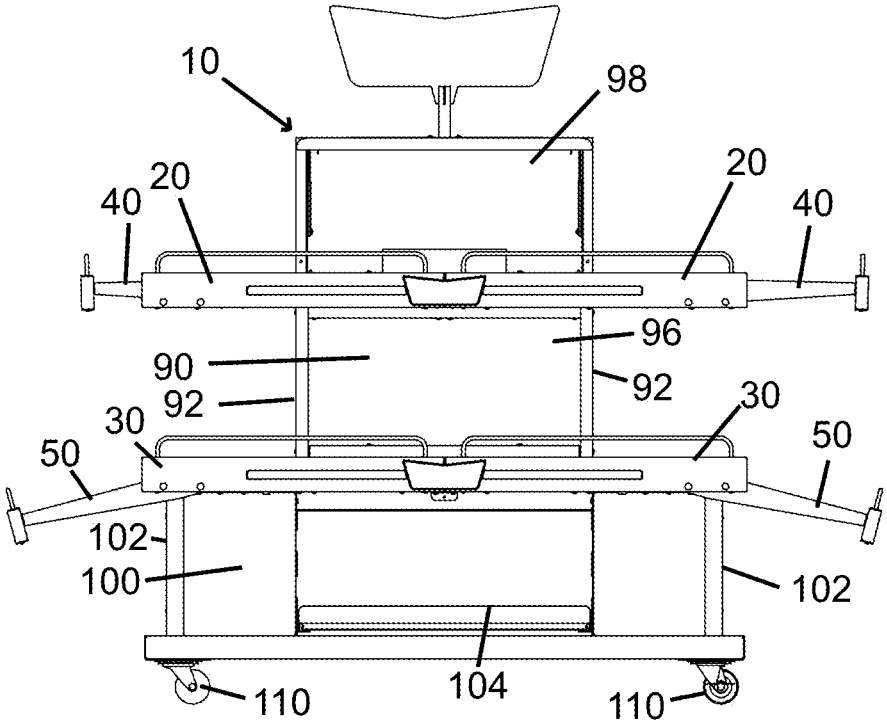
FIG. 2 is a side view of the standalone merchandise display and storage table in the position shown in FIG. 1.
Figure 3:
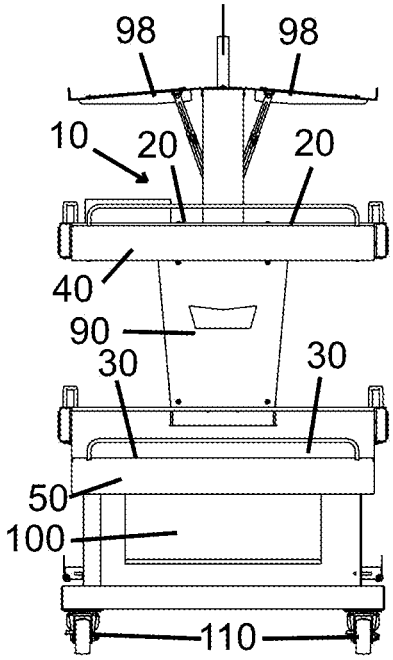
FIG. 3 is an end view of the standalone merchandise display and storage table in the position shown in FIG. 1.

The variability in display space is also shown in the side view of FIG. 2 and the end view of FIG. 3, both of which show the pull-out shelves 40 and 50 in the same positions depicted in FIG. 1. The upper shelf 40 on the left, as seen in FIG. 1 is in a first intermediate, extended position in which the upper shelf 40 is telescoped beyond and is in essentially the same plane as the upper counter 20 from which it extends. The upper shelf 40 on the right in FIG. 2 is in a second or additional intermediate, extended position, in which the right hand upper shelf 40 is extended further than the upper left hand shelf 40, but is still in essentially the same plane as the upper counter 20 from which it extends. Both of the lower pull-out shelves 50 are in a final and tilted position in which the lower shelves 50 are inclined relative to the lower counters 30 from which they extend. The pull-out shelves 50 in the tilted position provide slightly more display space than a shelf 40 or 50 in the second or additional intermediate position occupied by the right hand upper shelf 40 in FIG. 2. In this final, tilted position, the vertical distance between the upper shelf 40 and lower shelf 50 is greater that would be available when the lower shelf 50 is in either of the two intermediate positions occupied by the two upper shelves 40, shown in FIG. 2. This tilted configuration not only provides easier access to merchandise stored on the lower counter 30 and lower shelf 40, but also provides better visibility for the items or retailed merchandise stored on the lower counter 30 and lower shelf 40. Although not shown in the tilted position in FIG. 2, it should be apparent that both upper shelves 40 can also be tilted, and the lower shelves 50 can be positioned in either of the intermediate positions shown in FIG. 2.

The end view of FIG. 3 shows that additional storage and display space is provided by deployment of the two upper panels 98. With these panels 98 in a horizontal position, more retail merchandise can be presented for access by customers. The merchandise located on the upper counter 20 and on the upper pull-out shelves 40 remains accessible and view of this merchandise is not restricted.

Comparison of FIGS. 2 and 3 also shows that the extent of the counters 20, 30 and shelves 40, 50 is greater when viewed from the side, as shown in FIG. 2, than when viewed from the ends, as shown in FIG. 3. The standalone merchandise display and storage table 10 is especially suited for deployment in aisles of retail establishments, such as grocery stores, where it is important that the width of the relatively longer and narrower aisles not be unduly restricted. By providing multi-level extendable shelves 30 and 50 which project from the ends of the table 10, additional merchandise storage and display space can be provided with no greater obstruction or restriction of aisles. Customers can still have access to retail merchandise stored on both sides and both ends of the table 10, which will restrict passage by an amount no greater than would a simple table position in one of the aisles.

Figure 4:
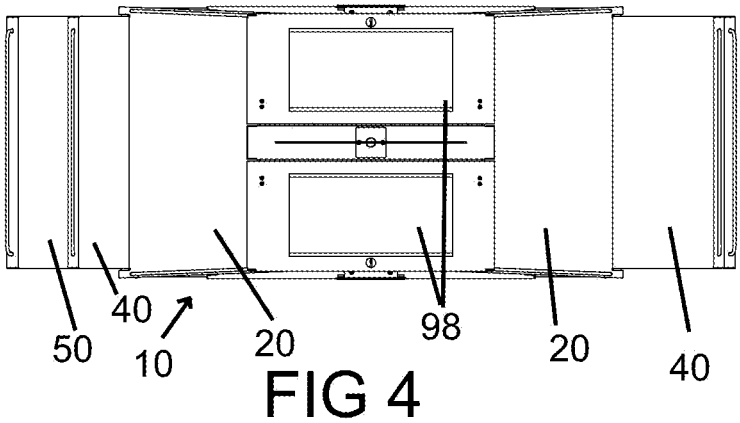
FIG. 4 is a top view of the standalone merchandise display and storage table in the position shown in FIG. 1.
Figure 5:
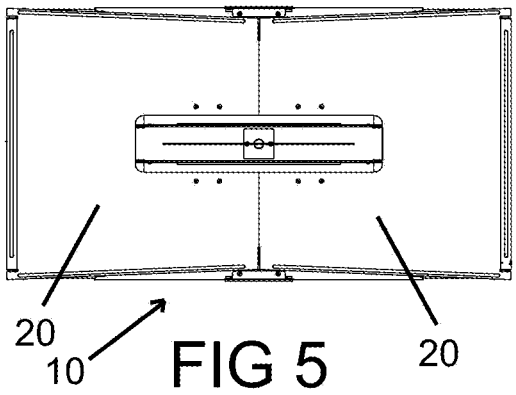
FIG. 5 is a top view of the standalone merchandise display and storage table with shelves on both ends in an initial or closed position, and the display space is limited to counters on opposite ends.

FIGS. 4 and 5 also show the potential variability of the retail and storage space that can be made available by the standalone merchandise display and storage table 10 of this invention. Both FIGS. 4 and 5 are seen from above, and FIG. 4 shows the configuration shown in FIG. 1, with shelves and panels deployed. FIG. 5 shows the configuration in which the shelves and panels are in the closed position as shown in FIG. 6.

The major components of the preferred embodiment of the standalone merchandise display and storage table 10 are shown in FIG. 7. Other components are mounted on a cabinet or base 100 defined in part by opposite endwalls 102 and sidewalls, which include side doors 104. The cabinet or base 100 is open on the top and the lower shelf assemblies formed by two counters 30 with telescoping shelves 50 are supported by the base 100. Side doors 104 as shown in FIGS. 6 and 7 will provide space for displaying graphic material, and when rotated to the position shown in FIGS. 1 and 2 will provide an additional horizontal surface on which merchandise can be stored and displayed.

The lower shelf assembly is formed of two preferably identical subassemblies, each formed by counter 30 and a pull-out shelf 50 that telescopes from an initial closed position, through intermediate positions to a final tilted position, depending upon the amount of retail merchandise that is to be displayed. The subassemblies, each formed on a lower counter 30 and a lower shelf 50 are positioned back to back so that the lower shelves can either be pulled from or returned in the direction in which the endwalls 102 face. Therefore the length of the table 10 can be altered, but its width will essentially remain the same. When used in an aisle of a retail establishment, this means that the available storage and display space can be increased without unduly obstructing the aisle.

The riser subassembly 90 is attachable to the two back to back lower counters 30 and will support upper counters 20, or shelf subassemblies formed by upper counters 20 and upper pull-out shelves 40. Riser subassembly 90 can be open on opposite sides to provide additional storage and display space. Storage and display space on lower counters 30 will, however, extend completely around the riser subassembly 90 so that merchandise stored on lower counters 30 will be accessible to customers in any direction.

Two back to back upper counters 20, or upper shelf subassemblies formed by upper counters 20 and upper pull-out shelves 40 are attached to the top of central compartments 90 by conventional means. As with the lower pull-out shelves 50, the upper pull-out shelves can be either extended or retracted without interference by the central compartment 90.

Upper panels 98 are mounted on top of and in the center of the upper counters 20, and these upper panels can either extend vertically in a retracted position or horizontally in an extended position. In the vertical position, as seen in FIG. 6, advertising media, including branding and pricing information can be displayed. In the horizontal position, as seen in FIG. 1, these extended panels will provide additional storage and display space without interfering with access to merchandise stored on the upper counters 20 and pull-out shelves 40 from all directions.

Figure 8A:
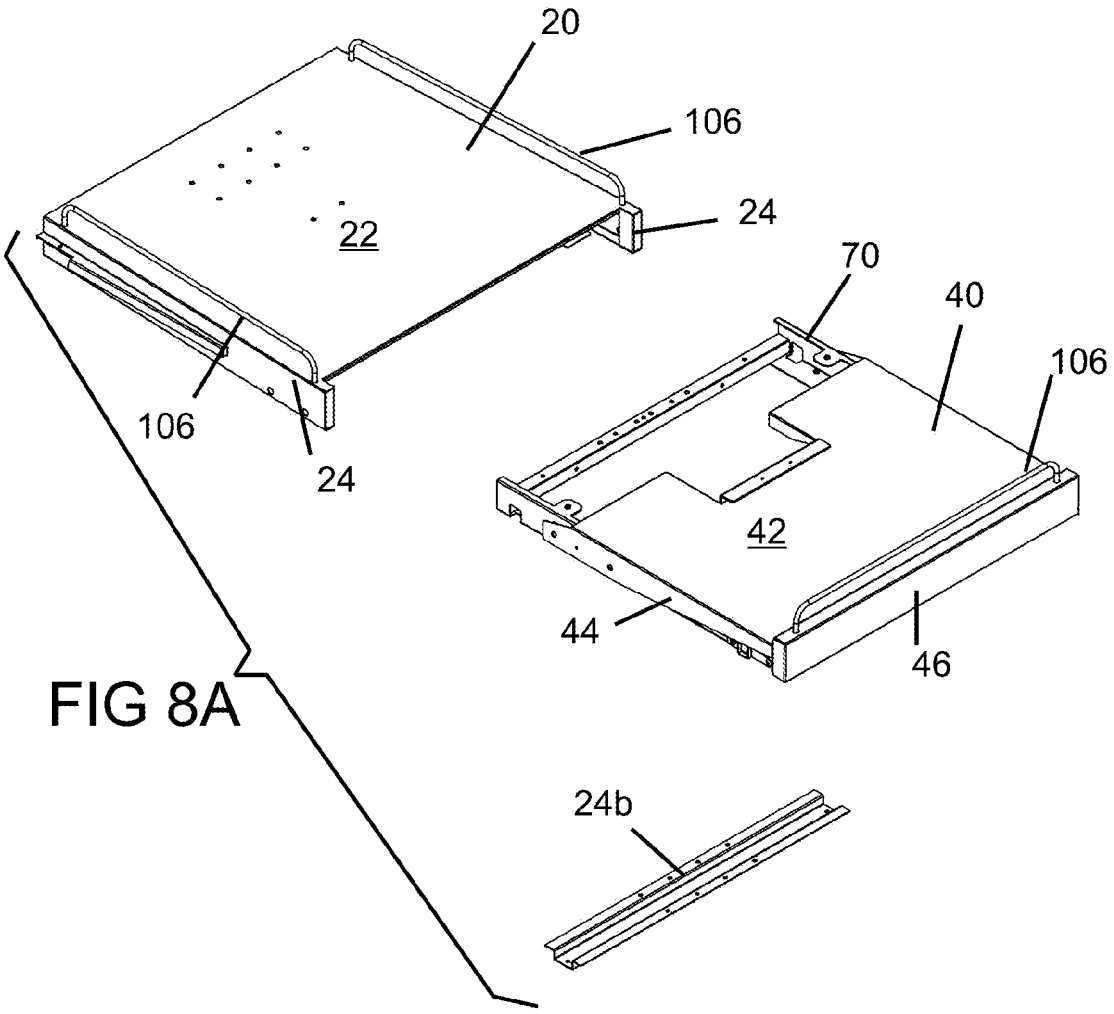
FIG. 8A is an exploded view showing the main components of one counter and shelf subassembly.
Figure 8B:
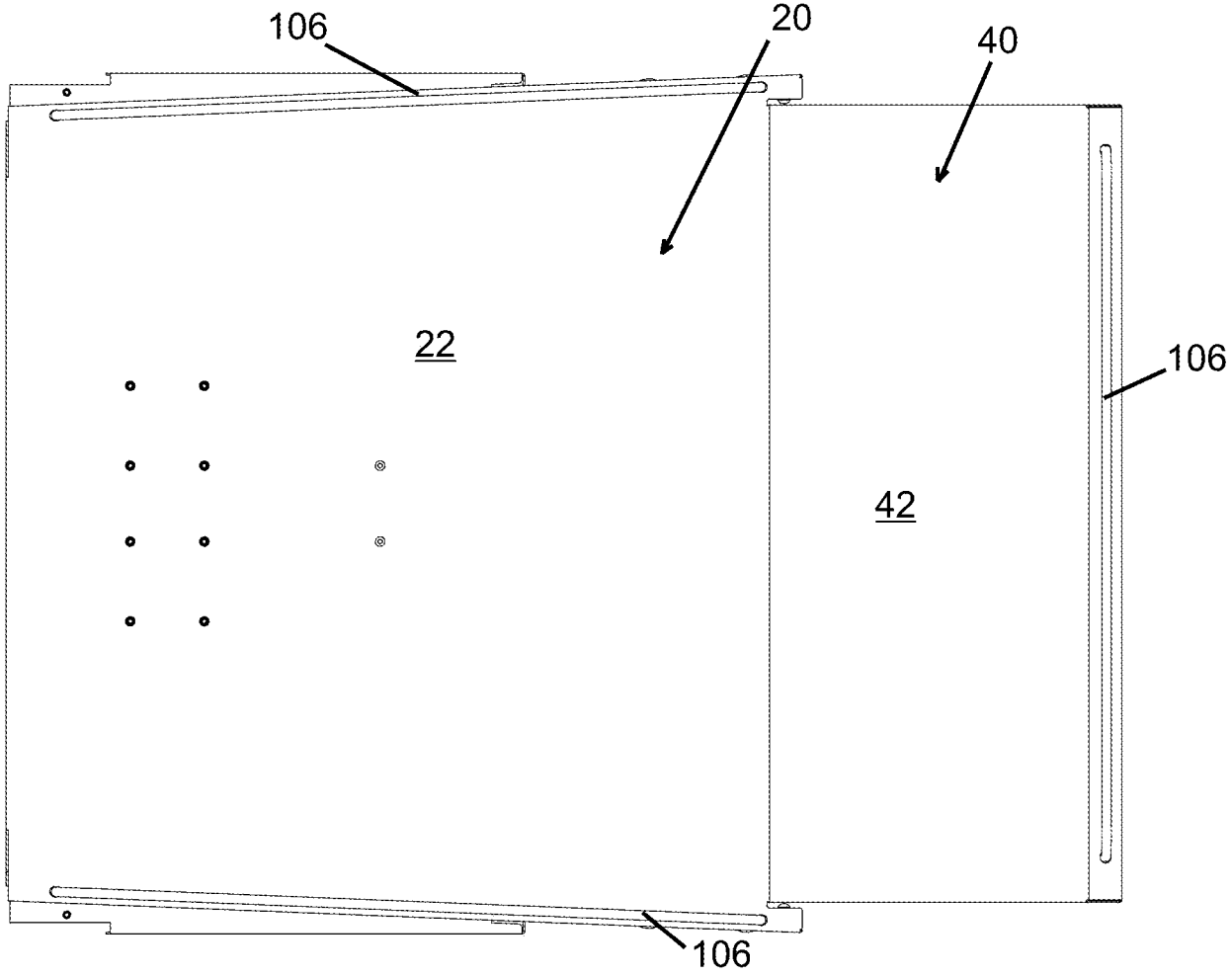
FIG. 8B shows the trapezoidal shape of one of the counter sections with a rectangular shelf extended partially therefrom.

FIG. 8 shows the main components of an upper shelf subassembly including an upper counter 20 and an upper pull-out shelf 40, which telescopes relative to the upper counter 20 when extended or retracted. The lower shelf subassembly including lower counter 30 and lower pull-out shelf 50 is essentially the same in the preferred embodiment. In the closed position, the pull out-shelf is retracted beneath the upper display surface 22 of counter 20 and between the upper counter side flanges 24 on opposite sides. In the closed position, the shelf display surface 42 is retracted beneath the counter display surface 22, but when extended, the shelf display surface is available for storage and display of additional merchandise. Product guide rods 106 are mounted on the periphery of the upper counter 30 and the shelf 40 to prevent product from falling. An end face 46 of the shelf 40 extends along its leading edge and provides both a facade in front of the shelf mounting mechanism as well as a structure that can be grasped as the shelf is extended from or retracted into the counter 20. The shelf 40 is mounted on and shiftable relative to a shelf frame 70. A hat brace 24*b* is beneath the counters and serves to stabilize and add rigidity to the counter panels and the frame, and provides a mount upon which upper components can be mounted.

Figure 9A:
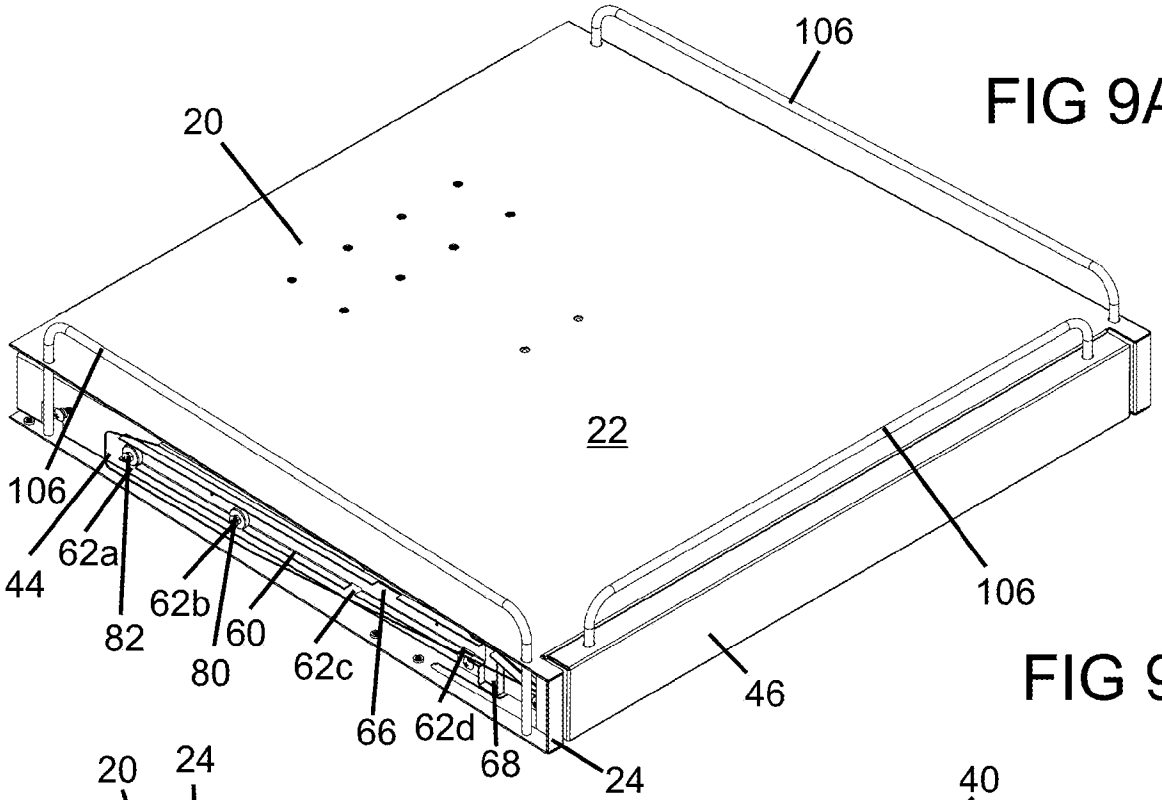
FIG. 9A is an illustrative view of an assembled counter and shelf subassembly in an initial or closed position and FIG. 9B is an illustrative side view of the assembled counter and shelf subassembly in the initial or closed position.
Figure 9B:
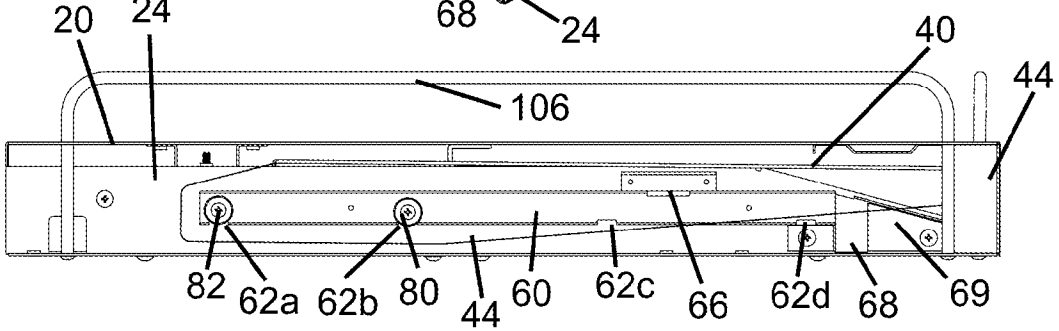

FIG. 9A shows the upper shelf subassembly in an initial closed position, and FIG. 9B shows the side of the upper shelf subassembly showing the relative positions of counter components and shelf components. FIGS. 9A and 9B, as well as FIGS. 10A, 10B, 11A, 11B, 12A and 12B are illustrative views to show the action of various moving components. Although certain components might be hidden, especially in the side views, these components are nevertheless shown as exposed for a better understanding of their structure and operation. These illustrative Figures show the relationship between one upper counter 20 and one upper shelf 40, but it should be understood that this relationship is the same for both oppositely facing upper shelf subassemblies as well as for the lower shelf subassemblies including lower counters 30 and lower shelves 50.

A track or channel 60 is mounted on the shelf frame 70 that is covered by the side counter flange 24 on both sides of the counter 20. This track or channel 60 remains fixed relative to the counter 20 as the shelf 40 moves in both directions along the track 60. Two rolling bearings or roller bearings or rollers 80 and 82 are mounted on the shelf 40 and ride within the track 60 as the shelf 40 moves between an initial closed position, shown in FIGS. 9A and 9B, and a final, fully extended and tilted position, shown in FIGS. 12A and 12B. In the embodiment depicted herein, there are four notches 62*a*, 62*b*, 62*c* and 62*d* spaced along the lower rail of the track 60. These notches serve to position and restrain the pull-out shelf 40 in the initial closed position, in a first, partially extended, intermediate position, and in a second or additional, further extended, intermediate position. When the leading rolling bearing 80 is aligned with and extends partially into the second notch 62*b*, as shown in FIG. 9B, the shelf 40 will be in the initial closed position. The spacing between notches 62*a* and 62*b* is such that when in this initial, closed position, the trailing rolling bearing 82 will be aligned with the first notch 62*a*, while the leading rolling bearing 80 is aligned with notch 62*b*. Partial receipt of one or more rolling bearing 80 or 82 will stabilize the pull-out shelf in one of four operative positions. Receipt of only the leading rolling bearing 80 in the notch 62*b* should be sufficient to hold the shelf 40 in the initial closed position, but simultaneous receipt of trailing rolling bearing 82 in notch 62*a* will provide additional stability. There remains sufficient space between the upper railing of the track 60 and the rolling bearings 80 and 82 to disengage the rolling bearings 80 and 82 from the notches, either by pulling on the shelf 40 or lifting up on the front of the shelf 40, while pulling. Similar action occurs when the shelf 40 is pushed from one of the extended positions toward the closed position in which the shelf is fully or partially retracted within the counter 20. Two rolling bearings 80 and 82, received within tracks 60 on opposite sides of the counter 20 and the shelf subassembly will provide smooth rolling movement of the pull-out shelf 40, without binding or misalignment.

Figure 10A:
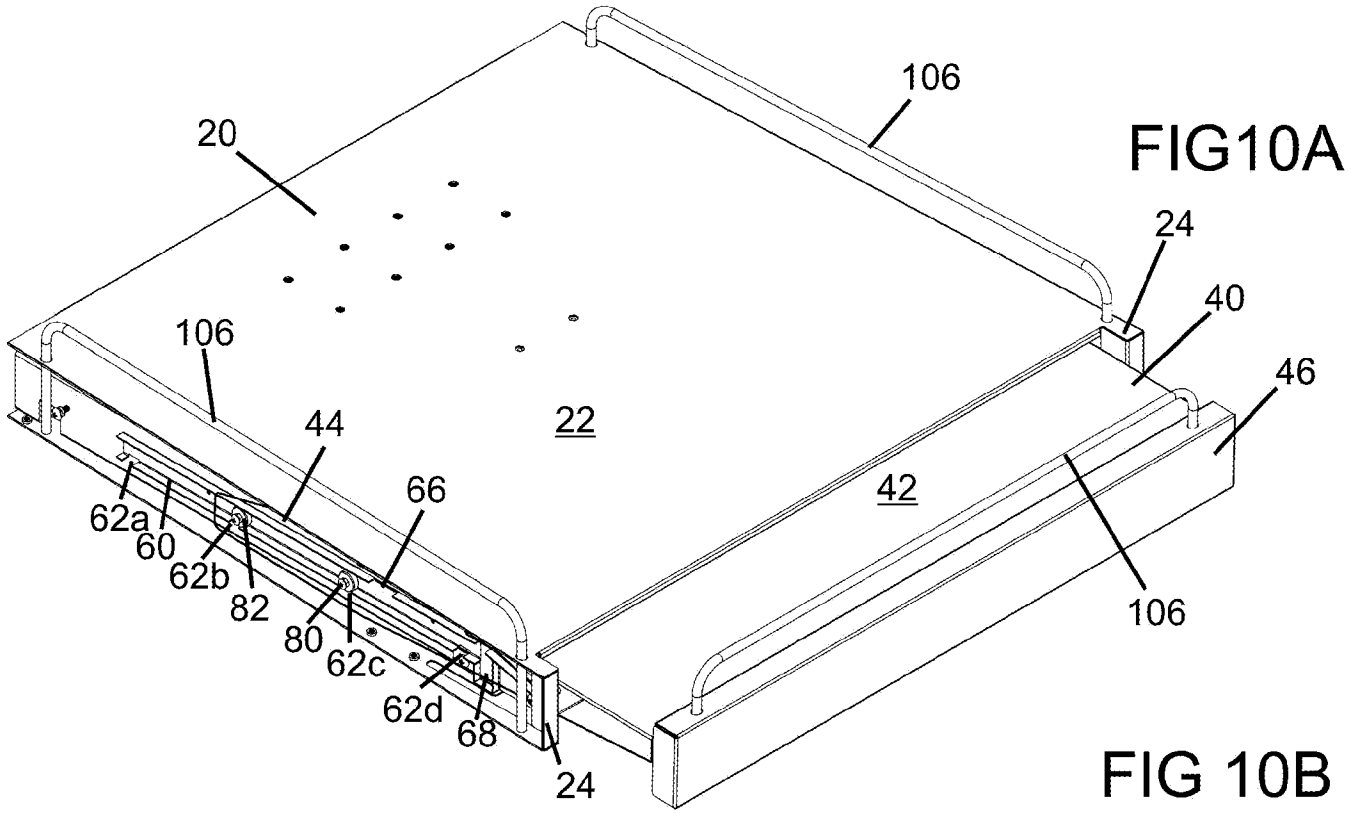
FIG. 10A is an illustrative view of an assembled counter and shelf subassembly in a first intermediate and partially extended position and FIG. 10B is an illustrative side view of the assembled counter and shelf subassembly in the first intermediate and partially extended position.
Figure 10B:
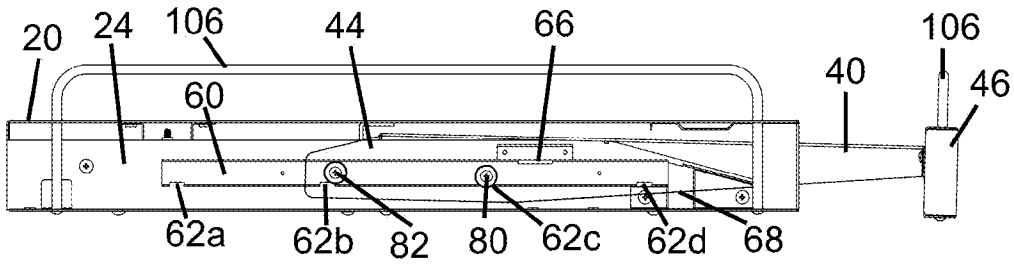

FIGS. 10A and 10B are similar to FIGS. 9A and 9B respectively, but show extension of the pull-out shelf 40 to a first intermediate or partially extended position. In this position the leading rolling bearing will be partially received in the notch 62*c*. Note that the spacing of the roller bearings 80 and 82 is not the same as the space between notches 62*b* and 62*c*, so the trailing rolling bearing 82 will not fit within any notch. The two rolling bearings 80 and 82 remaining in the essentially straight track will maintain the pull-out shelf in substantially the same planar orientation as when in the closed position shown in FIGS. 9A and 9B. However, the pull-out shelf will be effectively stabilized in the first intermediate position in which the shelf 40 and shelf display surface 42 is located essentially in the same plane, or in a plane only slightly spaced therefrom, as the counter 20 and the counter display surface 22. A larger, exposed and generally flat display surface is thus available for storing and displaying merchandise. The position of the shelf 40 in FIGS. 10A and 10B corresponds to the position of the left upper shelf 40 in FIG. 1.

Figure 11A:
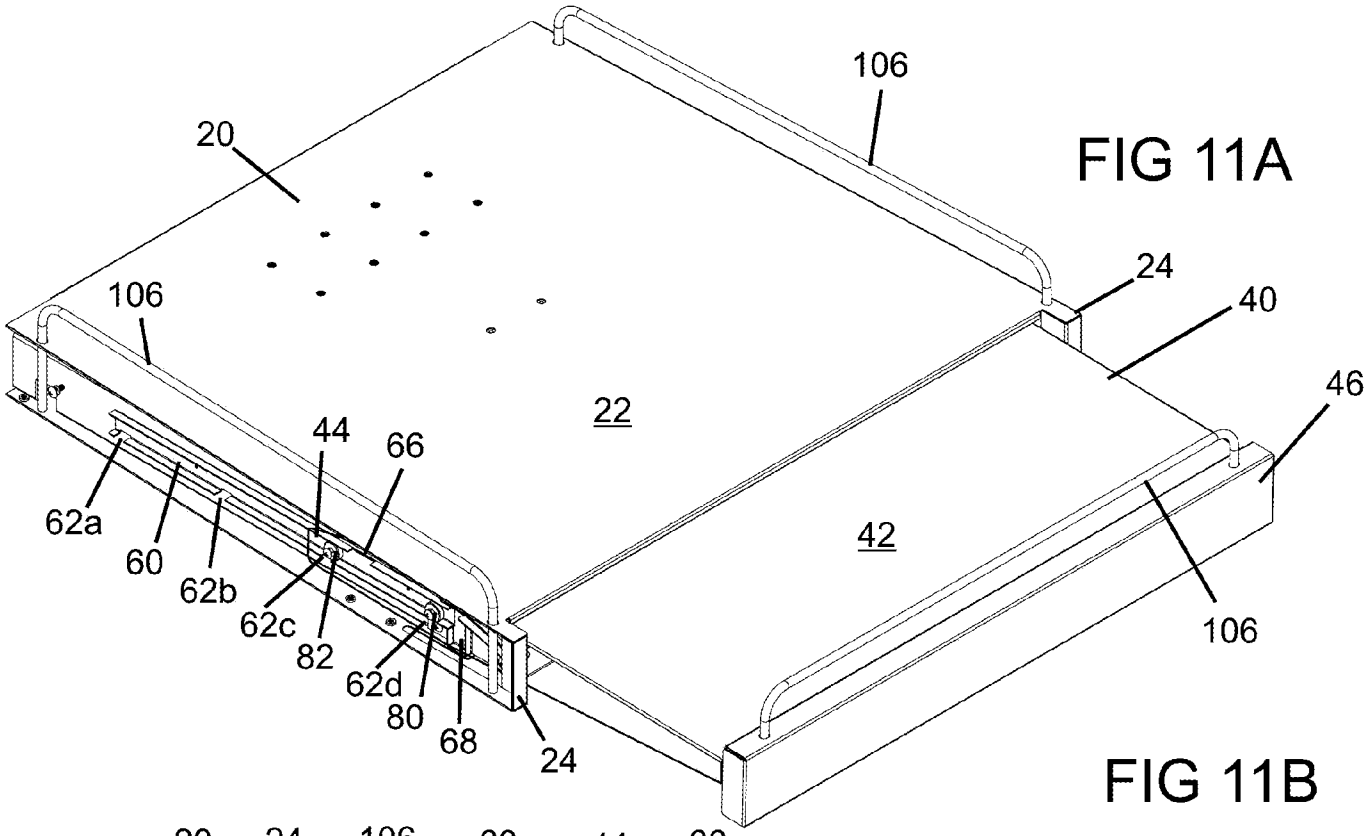
FIG. 11A is an illustrative view of an assembled counter and shelf subassembly in a second or additional intermediate position in which the shelf is extended further than in the first intermediate position and FIG. 11B is an illustrative side view of the assembled counter and shelf subassembly in the second or additional intermediate position.
Figure 11B:
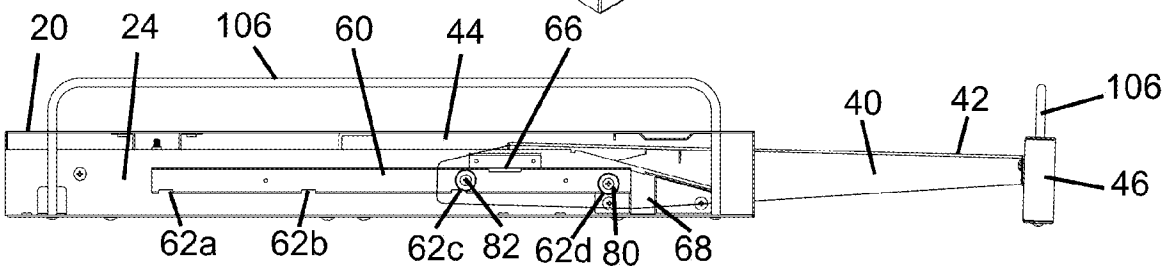

FIGS. 11A and 11B show the pull-out shelf 40 in a second or additional intermediate position in which the shelf 40 has been extended beyond the first intermediate position shown in FIGS. 10A and 10B. In this position, the leading rolling bearing 80 is aligned with and partially received within the notch 62*d*. This position corresponds to the position of the right hand upper shelf 40 in FIG. 1, and provides storage and display space, on essentially a flat extension of the upper counter 20, in addition to that provided in the first intermediate position of FIGS. 10A and 10B.

Figure 12A:
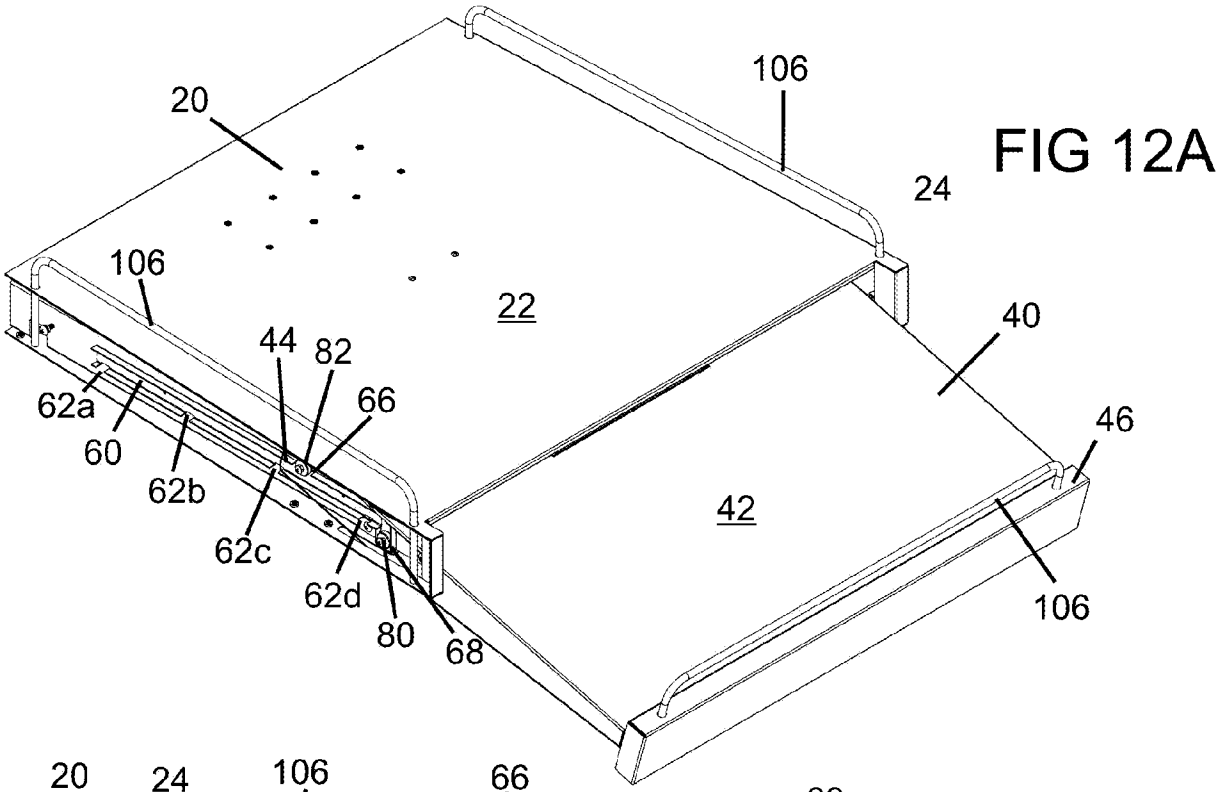
FIG. 12A is an illustrative side view of an assembled counter and shelf subassembly in a final fully extended position in which the shelf is tilted relative to the counter and FIG. 12B is an illustrative side view of the assembled counter and shelf subassembly in the final or fully extended, tilted position.
Figure 12B:
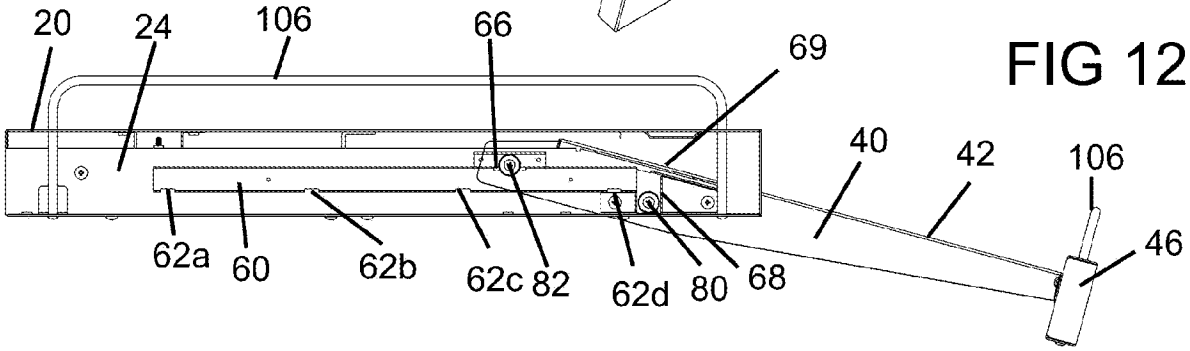

FIGS. 12A and 12B show the pull-out shelf 40 in a final, fully extended, and tilted position. In the tilted position the pull-out shelf 40 is extended horizontally and vertically beyond the intermediate, partially extended positions. The track 60 has a first or upper pocket 66 on the upper track rail. This pocket is formed by a gap that is large enough to receive the trailing rolling bearing 82 to a depth greater than that provided by the shorter notches 62*a*, 62*b*, 62*c* and 62*d* on the lower rail of track 60. A flange stop can be provided above the gap to form the first or upper pocket 66. A second or lower pocket 68 is formed in the lower rail of track 60 between the final notch 62*d* and the distal end of the counter 20 and the shelf track 60. The spacing between the upper pocket 66 and the lower pocket 68 is substantially the same as the spacing between the trailing rolling bearing 82 and the leading rolling bearing 80, so that when the leading rolling bearing 80 drops into the lower pocket 68, the trailing rolling bearing 82 will move upwardly into the upper pocket 66 so that the pull-out shelf 40 will be tilted relative to the counter 20. The center of gravity of the pull-out shelf 40 will be such that the rolling bearing 30 will drop into lower pocket 68 without requiring precise alignment by an operator. When product or merchandise is stored or displayed on the pull-out shelf 40, this tendency of the pull-out shelf to tilt will be even more pronounced. When the pull-out shelf 40 is to be retracted to its initial or closed position or to one of its intermediate positions, an operator can merely lift up on the forward end of the shelf 40, for example by grasping the shelf face 46, and pushing the pull-out shelf 40 toward the counter 20. An angled fairing 69 can be provided in front of the track 60 to assist in repositioning the rolling bearings 80 and 82 within the track 60. A gap may be provided between the angled fairing 69 and the track 60 to provide sufficient clearance for movement of the leading rolling bearing 80.

Figure 13:
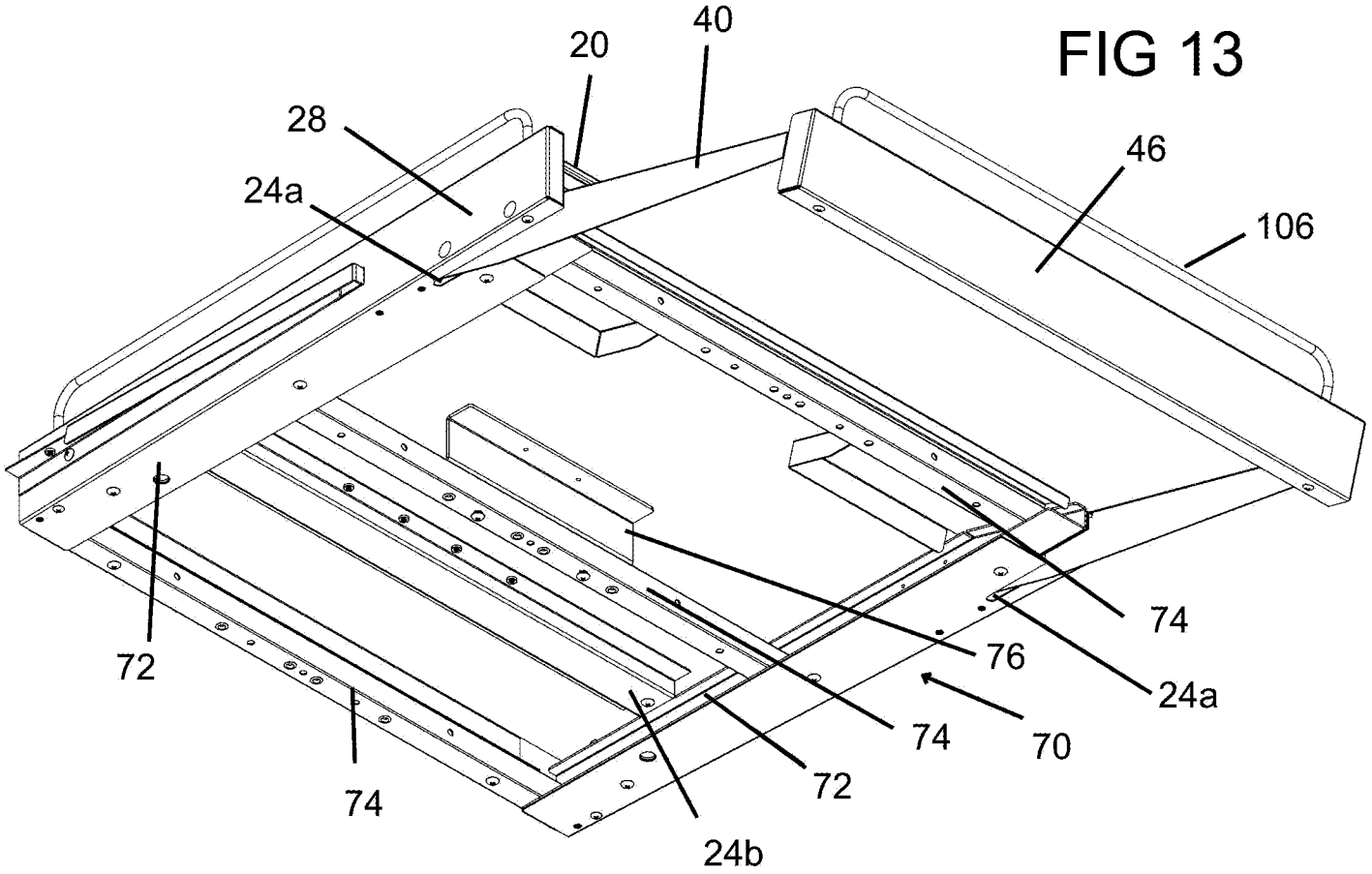
FIG. 13 is a three dimensional view from below showing the pull-out shelf in a tilted position and also showing the frame for mounting a shelf on a counter.

FIG. 13 is a three dimensional view showing the bottom of the shelf subassembly, with the pull-out shelf 40 in the same tilted position as shown in FIGS. 12A and 12B. Frame 70 mounts the sliding shelf 40 on the stationary counter 20 to form the shelf subassembly. Frame 70 includes two side beams that are joined by three transverse beams 74, one adjacent each opposite end and a third extending therebetween. The channels 60, as previously discussed, are located on the sides of the frame 70. A stabilizer bar member or Z bracket 76 comprises a centrally located L-shaped member mounted on a central transverse beam with the stabilizer bar member 76 engaging the shelf 40 through a cut-out at the rear of the shelf display surface 42. As the shelf 40 moves from the initial position toward the final tilted position, the display surface 42 with its cut-out moves away from the stabilizer bar subassembly, which retains an edge of the shelf 40 when in the closed position. A slot 24*a* provides clearance for the side walls 44 of the shelf 40 in the tilted position.

Figure 14:
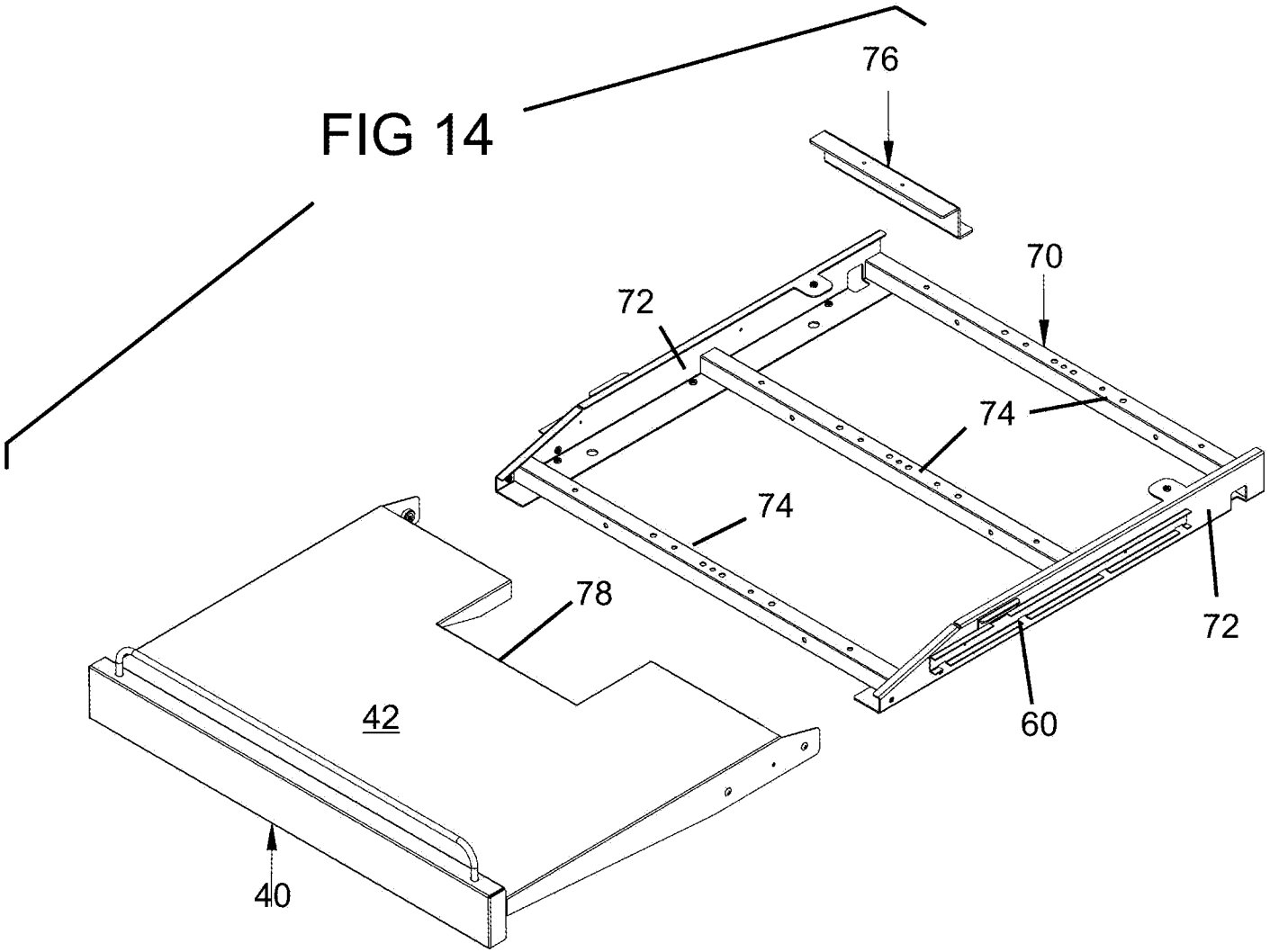
FIG. 14 is an exploded view showing a pull-out shelf and a frame for mounting the pull-out shelf on the counter portion of the shelf subassembly.
Figure 15:
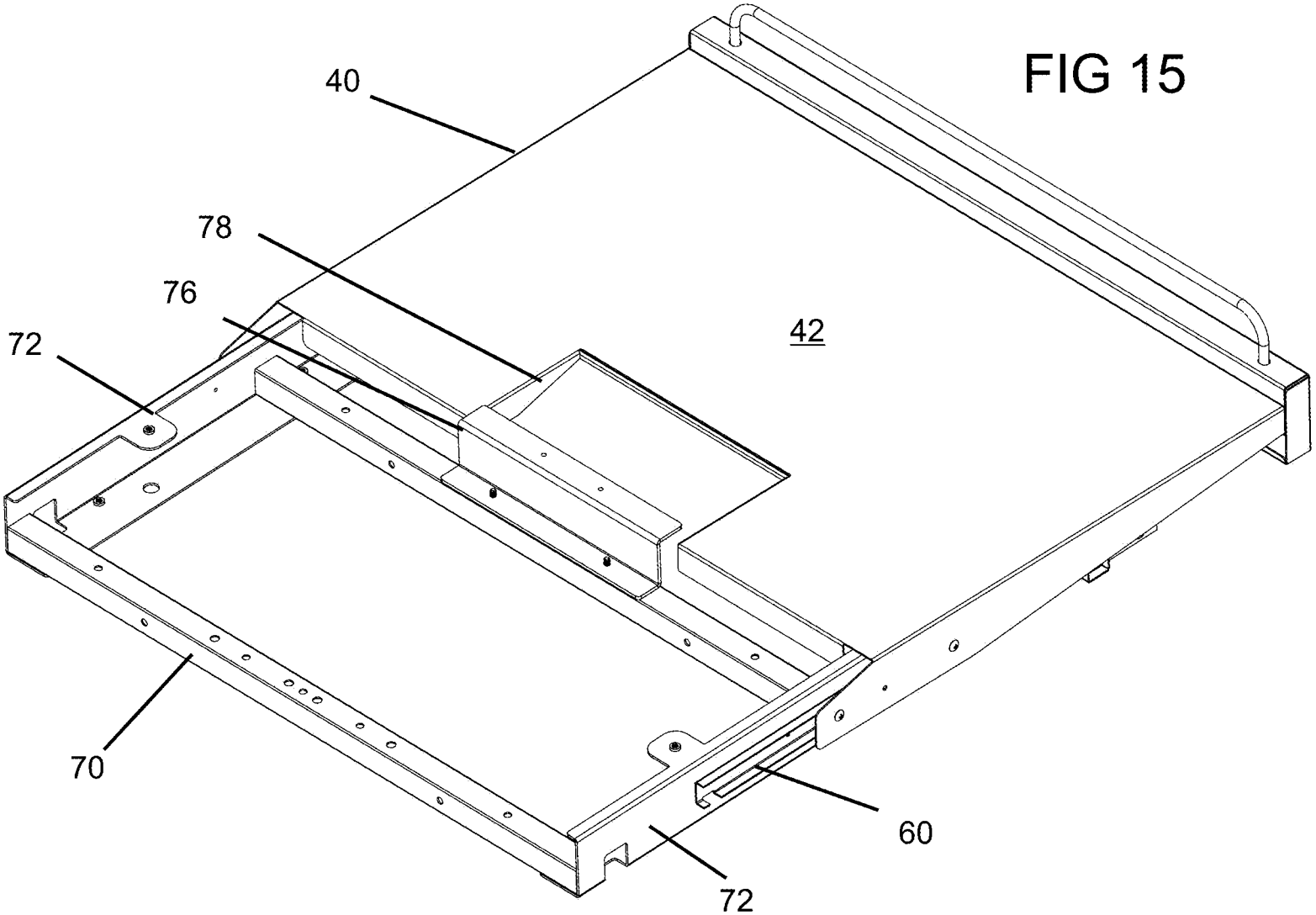
FIG. 15 is a view showing the position of a pull-out shelf in relation to a frame when the pull-out shelf is in an intermediate position.

FIG. 14 shows a pull-out shelf 40 exploded from the frame 70 with a track 60 shown on one of the side frame members 72. FIG. 15 shows the position of the shelf 40 relative to the frame 70 when the shelf 40 is in an intermediate position.

The frame 70 is mounted to the underside of the stationary counter 20. Since the shelf 40 is only attached to the stationary counter 20 by the frame 70, this means that the shelf 40 need not have the same shape or dimensions as the stationary counter 20. Perhaps more importantly the counter 20 can have a unique shape that need not conform to the shape of the pull-out shelf 40. In the preferred embodiment, the counter 20 does not have a rectangular profile. Instead the counter 20, in this representative embodiment, has a bow-tie or trapezoidal shape while the pull-out shelf 40 has a rectangular profile. See FIG. 8B. However the frame 70, which is hidden on the underside of the trapezoidal counter 20, has parallel sides on which the tracks 60 are mounted in a mutually parallel configuration. Thus the rectangular shelf 40 can be mounted on these parallel tracks 60, even though the sides of the counter 20 positioned above the frame 70 are not parallel.

Although this standalone merchandise display and storage table 10 is depicted herein as a multi-tier structure, it should be understood that other embodiments could employ the same inventive concept, but with a modified structure. For example, only a single level with counters and shelves mounted on a cabinet could be employed in situations that might not require the same amount of display and storage space. The same or very similar components could be employed to fabricate such a structure. It should also be understood that the instant invention is not limited to a table having only two levels. The preferred embodiment depicted herein is especially suited for fabrication employing sheet metal for the primary components. It should be understood that other materials, such as plastic or wood could be employed to fabricate at least some of the components. Alternatively the pull-out shelf subassemblies could be configured with the multiple counter sections side by side and multiple pull-out shelves could extends side by side, all being extendable in the same direction. These and other modifications would be apparent to one of ordinary skill in the art, and it should therefore be apparent that this invention is not limited to the specific representative embodiment depicted herein, but is instead described by the following claims.

We claim:

1. A standalone merchandise display and storage table on which retail merchandise is located for sale in a retail establishment, the standalone merchandise display and storage table providing variable display and storage space for retail merchandise and comprising:

an upper counter located above a lower counter oriented so that retail merchandise stored on both the upper counter and the lower counter is accessible from all directions;

multiple upper shelves extendable from and beyond opposite ends of the upper counter and multiple lower shelves extendable from and beyond opposite ends of the lower counter, the upper shelves being shiftable relative to the upper counter to vary storage and display space for retail merchandise and the lower shelves being shiftable relative to the lower counter to vary storage and display space for retail merchandise so that the standalone merchandise display and storage table can appear fully stocked both when initially stocked with retail merchandise and as retail merchandise are depleted prior to restocking the upper and lower counters and upper and lower shelves;

wherein the upper shelves and the lower shelves are shiftable from and beyond the respective counters so as not to interfere with customer's access to retail merchandise displayed and stored on the counters or with visibility of retail merchandise stored on the counters; and wherein the upper shelves are extendable to and securable in an upper intermediate position in a common plane with the upper counter; and wherein the upper shelves are extendable beyond the upper intermediate position to a final upper position in which the upper shelves are tilted relative to the upper counter.

2. The standalone merchandise display and storage table of claim 1 wherein the lower shelves are extendable to and securable in a lower intermediate position in a common plane with the lower counter.

3. The standalone merchandise display and storage table of claim 1 wherein the lower shelves are extendable beyond the lower intermediate position to a final lower position in which the lower shelves are tilted relative to the lower counter while remaining in a position for storage and display of retail merchandise.

4. The standalone merchandise display and storage table of claim 1 wherein oppositely facing upper panels extend above the upper counter, the oppositely facing upper panels shiftable between a vertical position and a horizontal position, the oppositely facing upper panels displaying advertising media when in the vertical position and providing additional display and storage space for retail merchandise when in the horizontal position.

5. The standalone merchandise display and storage table of 1 wherein a base extends below the lower counter, the base including doors on opposite sides that are shiftable from a closed position to an open position supporting additional display and storage space.

6. A grocery store merchandise and display table positionable in an aisle with access to the table on opposite sides and opposite ends, the opposite sides being longer than the opposite ends to minimize obstruction of traffic in the aisles while being resizable to allow storage and display of varying amounts of product, the table comprising:

a base of the table including doors on opposite sides of the base, the doors being shiftable between horizontal and vertical positions, so that product is storable and accessible within the base when the doors are in the horizontal position;

a first counter located on top of the base, the first counter being open on opposite sides and opposite ends of the table for removal of product on the first counter by customers;

a riser subassembly extending above a center section of the first counter, the riser subassembly having risers forming opposite end walls thereof with product being storable and accessible between the opposite end walls;

a second counter located above the first counter and supported by the risers, the second counter being open on opposite sides and ends of the table for removal of product on the second counter by customers, first and second counters having the same amount of area for the storage and display of product, with product on the first and second counters being visible at all times; oppositely facing upper panels centrally positioned and extending above the second counter, the oppositely facing upper panels comprising graphic display panels when in a vertical position and providing additional storage and display space when rotated upwardly into a horizontal position above the second counter;

lower and upper shelves extendable respectively from opposite ends of the first and second counters to increase product display and storage space without increasing the lateral extent of opposite sides of the grocery store merchandise and display table so as not to further restrict obstruction of the aisles in which the grocery store merchandise and display table is deployable;

wherein the table can be configured to display varying amounts of product so as to be suitable of use in areas having different amounts of product turnover.

7. The table of claim 6 wherein the lower and upper shelves are located beneath the first and second counters in an initial position, and are extendable along paths parallel to the first and second counters to an intermediate position to increase product display and storage space and to a final position in which the lower and upper shelves are tilted relative to the first and second counters respectively.

8. The table of claim 6 wherein the table comprises a standalone and portable grocery store merchandise and display table.

9. A standalone merchandise display and storage table including a shelf subassembly comprising a counter and a shelf both providing space for display of merchandise, the shelf being shifitable relative to the counter to vary display and storage space of retail merchandise, wherein:

the shelf is shiftable relative to the counter from an initial position in which the shelf is retracted within the counter to an intermediate position in which the shelf extends beyond the counter and is securable in the same plane as the counter and from the intermediate position to a final position in which the shelf is tilted relative to the counter while remaining a display and storage space; and wherein tracks are mounted on opposite sides of one of the counter and shelf and forward rolling bearings and trailing rolling bearings are mountable on opposite sides of the other of the counter and shelf, the forward rolling bearings and the trailing rolling bearings traversable along the tracks as the shelf shifts between the initial and intermediate positions, and wherein the forward rolling bearings extend beyond and at least partially below the tracks in the final position and wherein the trailing rolling bearings extend at least partially above the tracks in the final positon to allow tilting of the shelf relative to the counter but retaining the shelf in a configuration for display and storage of merchandise when tilted.

10. The standalone merchandise display and storage table of claim 9 wherein at least one of the forward and trailing rolling bearings fit partially within an inner notch in a lower surface of the tracks when the shelf is in the initial position to secure the shelf in the initial position and lifting of the shelf relative to the counter releases the at least one of the forward and trailing rolling bearing from the inner notch for movement of the shelf to the intermediate position.

11. The standalone merchandise display and storage table of claim 10 wherein at least one of the forward and trailing rolling bearings fit partially within an outer notch in a lower surface of the tracks when the shelf is in the intermediate position to secure the shelf in the intermediate position and lifting of the shelf relative to the counter releases the at least one of the forward and trailing rolling bearing from the outer notch for movement of the shelf to the final position.

12. The standalone merchandise display and storage table of claim 11 wherein a first pocket extends below one of the tracks at a location beyond the outer notch, the forward rolling bearing being received in the first pocket when the shelf is tilted relative to the counter in the final position.

13. The standalone merchandise display and storage table of claim 12 wherein a second pocket extends above one of the tracks at a location between the outer notch and the first pocket, the trailing rolling bearing being received in the second pocket when the shelf is tilted relative to the counter in the final position.

14. The standalone merchandise display and storage table of claim 9 wherein an additional intermediate position is located between the intermediate position and the final position, when in the additional intermediate position the shelf extending beyond the intermediate position of shelf, when in the additional intermediate position and when in the final position, the shelf being tilted relative to the orientation of the shelf in the additional intermediate position.

15. The standalone merchandise display and storage table of claim 9 wherein opposite sides of the counter are mutually nonparallel and opposite sides of the shelf are mutually parallel.

16. The standalone merchandise display and storage table of claim 15 wherein a frame having mutually parallel frame sides is mounted to the counter on a lower surface thereof with parallel tracks mounted on the frame receiving rolling bearings on the shelf so that the shelf can slide relative to the nonparallel sides of the counter.

* * * * *